US005229557A

United States Patent [19]

Allman et al.

[11] Patent Number: 5,229,557

[45] Date of Patent: Jul. 20, 1993

[54] RIGIDIFIED MUFFLER ASSEMBLY

[75] Inventors: James Allman, North Vernon; Richard Wilcox; Thomas Rohm, both of Columbus, all of Ind.

[73] Assignee: Arvin Industries, Inc., Columbus, Ind.

[21] Appl. No.: 706,169

[22] Filed: May 28, 1991

[51] Int. Cl.[5] ..... F01N 1/02

[52] U.S. Cl. ..... 181/282; 181/272; 181/276

[58] Field of Search ..... 181/282, 276, 272

[56] References Cited

U.S. PATENT DOCUMENTS

| | | | |
|---|---|---|---|
| Re. 33,370 | 10/1990 | Harwood | 181/282 |
| 3,140,755 | 7/1964 | Tranel | 181/282 |
| 3,638,756 | 2/1972 | Thiele | 181/282 X |
| 4,396,090 | 8/1983 | Wolfhugel | 181/282 |
| 4,456,091 | 6/1984 | Blanchot | 181/282 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,821,840 | 4/1989 | Harwood et al. | 181/282 |
| 4,847,965 | 7/1989 | Harwood et al. | 29/157 R |
| 4,860,853 | 8/1989 | Moring | 181/282 |
| 4,865,154 | 9/1989 | Hanson et al. | 181/282 |
| 4,894,987 | 1/1990 | Harwood et al. | 181/282 |
| 4,901,815 | 2/1990 | Harwood et al. | 181/282 |
| 4,901,816 | 2/1990 | Garey | 181/282 |
| 4,905,791 | 3/1990 | Garey | 181/282 |
| 4,909,348 | 3/1990 | Harwood et al. | 181/282 |
| 4,924,968 | 5/1990 | Moring et al. | 181/282 |
| 4,928,372 | 5/1990 | Harwood et al. | 29/890.08 |
| 4,941,545 | 7/1990 | Wilcox et al. | 181/282 |
| 4,953,660 | 9/1990 | Jewell, Jr. et al. | 181/282 |
| 4,958,701 | 9/1990 | Moring | 181/282 |
| 5,004,069 | 4/1991 | Van Blaircum et al. | 181/282 |

FOREIGN PATENT DOCUMENTS

| | | |
|---|---|---|
| 59-43456 | 12/1984 | Japan . |
| 2120318A | 11/1983 | United Kingdom . |

*Primary Examiner*—Michael L. Gellner
*Assistant Examiner*—Eddie C. Lee
*Attorney, Agent, or Firm*—Barnes & Thornburg

[57] ABSTRACT

The invention relates to a rigidifying structure used to support half shells of a stamp-formed muffler by connecting at least one of the half shells to an inner plate disposed in the space between the half shells so that shell noise is minimized.

61 Claims, 5 Drawing Sheets

RIGIDIFIED MUFFLER ASSEMBLY

BACKGROUND AND SUMMARY OF THE INVENTION

This invention relates to exhaust systems and, in particular, to mufflers for controlling and reducing noise associated with engine exhaust gas. More particularly, this invention relates to stamp-formed mufflers having internal stamped sheet metal tuning plates or a plurality of tuning tubes fixed inside a muffler chamber formed by two mating external shells and rigidifying mechanisms for the external shells.

For several years, mufflers have been constructed using stamp-formed sheet metal shells and plates. Although some conventional stamped mufflers can be assembled using fewer component parts than conventional tube mufflers, it is nevertheless recognized that it is necessary to modify the design of conventional stamped mufflers to improve the manufacturability and noise management qualities of stamped mufflers. For example, it has been observed that weld process time for assembling conventional stamped mufflers is high and that it is often necessary to to rely on costly, space-consuming, and labor-intensive welding equipment to assemble conventional stamped muffler components. It will be appreciated that the unit cost of each stamped muffler can rise significantly if the weld process time allocated for muffler assembly is very large.

All mufflers vibrate during use because of irregular pulsation of high-temperature, vehicle exhaust gas conveyed through the muffler chambers and passageways. Such pulsations are known to vary between 25 and 300 cycles per second in an irregular pattern and create muffler shell vibration and noise. Stamped mufflers are particularly susceptible to excessive shell noise problems due, in part, to a lack of adequate internal support structure for the muffler shells.

Shell noise is often produced because one or both of the outer shells that are joined together to form the outer skin of the muffler flex during movement of hot exhaust gases through the muffler. Numerous factors such as basic shell design, material gage, and unsupported spans between baffles provided in a muffler contribute to creation of shell noise during muffler operation. Further, in some instances, where no or few internal baffles are installed or present in a muffler, the frequency of shell noise problems can be significant.

According to the present invention, a muffler assembly includes a pair of half shells, at least one plate disposed in an interior region between the shells, and at least one rigidifying structure extending between the at least one plate and one of the shells to support the shell without dividing the space between the plate and the shell into a further subchamber to rigidify the muffler assembly and reduce flexing of the shell relative to the plate. Advantageously, provision of such a rigidifying structure can lead to a reduction in shell noise without creating any more subchambers in the interior region of the muffler assembly.

In one embodiment of the present invention, a muffler assembly includes a first shell half and a second shell half attached to the first shell half at a perimetrically extending split line to define an enclosed area therebetween. The first and second shell halves cooperate to define a flange-receiving space therebetween at the split line. An inlet port is provided in the muffler assembly for admitting exhaust gas into the enclosed area and an outlet port is also provided for expelling exhaust gas from the enclosed area.

A first inner tuning plate is disposed in the enclosed area. The first inner tuning plate has a flange edge trapped in the flange-receiving space to retain the first inner tuning plate in a fixed position dividing the enclosed area into a first chamber between the first inner tuning plate and the first shell half and a second chamber between the first inner tuning plate and the second shell half. A second inner tuning plate is also disposed in the second chamber.

The first and second inner tuning plates each have channel-forming depressions which cooperate to define exhaust gas conducting tubes connected to the muffler chamber inlet and outlet when the plates are joined together. Means is provided for attaching the second inner tuning plate to the first inner tuning plate in piggyback relation to provide the exhaust gas conducting tubes. The second inner tuning plate is thereby retained in mating engagement with the first inner tuning plate without extending into the flange-receiving space at the split line so that only the first shell half, second shell half, and first inner tuning plate are rigidly joined together at the split line. Once joined together, the channel-forming depressions in the first and second inner tuning plates are aligned to form tubes for conducting exhaust gases therethrough.

Advantageously, the inventive muffler assembly is made of stamp-formed components which can be assembled quickly and easily without using costly complex welding techniques. The muffler assembly is also constructed to reduce shell noise associated with vibration occurring during muffler use.

The invention contemplates, for example, providing a rigidifying structure connecting at least one of the depressions on one of the inner plates to its adjacent half shell to rigidify the half shell. This feature will help to eliminate shell noise caused by flexing of the shell during passage of engine exhaust product through the muffler. Shell flexing is of course determined by the basic shell design (e.g., support rib locations if any, material and thickness of material, distance between supports, speed and pressure of exhaust gas flow, resonant frequency of engine and muffler, etc.).

It is also contemplated that each channel-forming depression could have a rigidifying structure or only those channel-forming depressions adjacent long unsupported spans of the half shells would be provided with rigidifying structures. Preferably, the rigidifying structures extend from the channel-forming depressions since their outer surface is closest to the unsupported half shell and this would reduce the size, weight, and material necessary to create the rigidifying structure. Alternatively, it is possible to connect the rigidifying structures to the tuning plates between adjacent depressions. Also, the rigidifying structures can be fitted with holes to allow for welding.

It is contemplated that the rigidifying structure could be raised portions drawn or pressed from the material that makes up the depressions and/or the half shells. Alternatively, an extra piece of material could be inserted between the half shell and the depression to form a rigidifying structure.

It is important to minimize the effect on chamber (sub-chamber) volume by these rigidifying structures and accordingly they are made to extend over a small cross-sectional area of the chamber (sub-chamber) so as not to reduce its volume and hence maintain nose abatement and acoustic control.

In other embodiments, the muffler assembly includes a plurality of flow tubes and baffles placed in the interior region between the shells to control the flow of vehicle exhaust gas through the muffler assembly. Such a hybrid tube and baffle design is also susceptible to shell noise problems, and provision of one or more rigidifying structures in accordance with the present invention can lead to a reduction in shell noise.

Other objects, advantages, and novel features of the present invention will become apparent from the following detailed description of the invention when considered in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
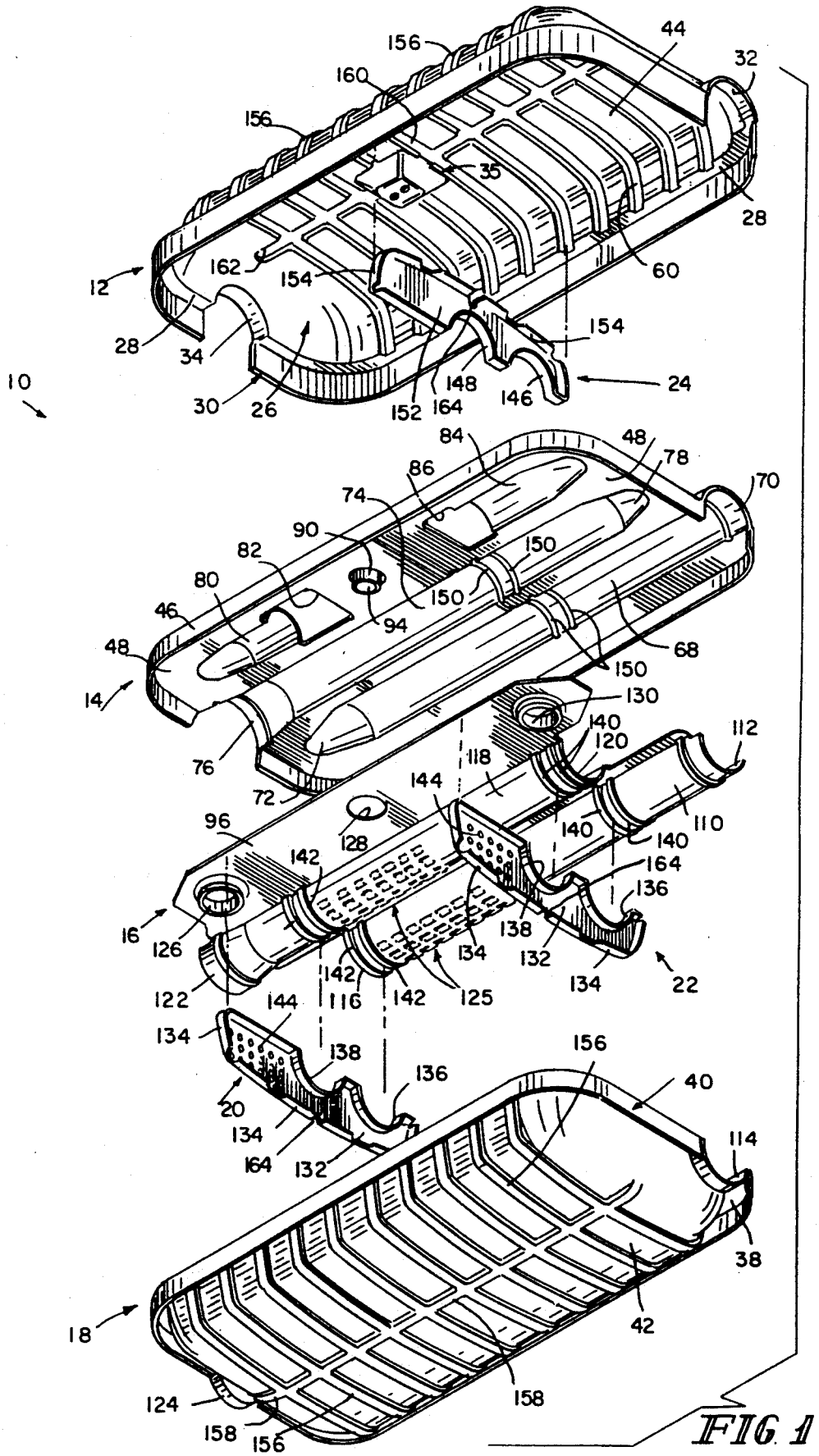
FIG. 1 is an exploded view showing various unassembled, stamp-formed top and bottom shells, internal plates, and drop-in baffles included in a rigidified muffler assembly in accordance with a first embodiment of the present invention and, in particular, a rigidifying structure formed in an interior wall of the top shell.

Muffler assembly 10 includes a top shell half 12, a full tuning plate 14, an insert tuning plate 16, a bottom shelf half 18, a pair of drop-in baffles 20, 22 for use in the bottom shell half 24, and a single drop-in baffle 14 for use in the top shell half 12, as shown in FIG. 1. In the illustrated embodiment, each of these components is stamp-formed sheet metal. For example, aluminized and non-aluminized cold-rolled steel or AISI/SAE grade 409 stainless steel are suitable for stamping to form the stamped components of muffler assembly 10.

Top shell half 12 includes a hollowed basin 26 having a flat horizontal perimeter shelf 28 around the cavity provided by basin 26 and an upstanding, thin-walled, perimetrically extending skirt 30 appended to shelf 28 as shown in FIG. 1. The basin 26 and skirt 30 are cut away as shown at 32 to provide an inlet opening into basin 26 and at 34 to provide an outlet exiting basin 26.

The top shell half 12 further includes a rigidifying structure 35 as shown in FIGS. 1-4. This rigidifying structure 35 is configured to engage a portion of tuning plate 14 in the manner described below to add rigidity to muffler assembly 10. In particular, such a rigidifying structure 35 is separate from drop-in baffles 20 or 22 and only serves to support the top shell half 12 to minimize shell noise without dividing the interior region of the muffler assembly 10 into any more subchambers.

Bottom shell half 18 likewise includes a hollowed basin 36 and a perimeter web 38 surrounding the cavity provided by basin 36. A skirt 40 is formed along the outer perimeter of web 38 to extend from web 38 in a direction toward the bottom wall 42 of bottom shell half 18. In contrast, skirt 30 formed along the outer perimeter of shelf 28 on top shell half 12 extends from shelf 28 in a direction away from the bottom wall 44 of top shell half 12. It will be understood that skirts 30 and 40 will lie in substantially spaced-apart parallel relation around the perimeter of muffler assembly 10 once all of the muffler components are put together as shown in FIG. 1 to provide a space extending about the muffler perimeter. This space is sized to receive a perimeter lip or flange 46 provided on the full tuning plate 14.

Figure 2:
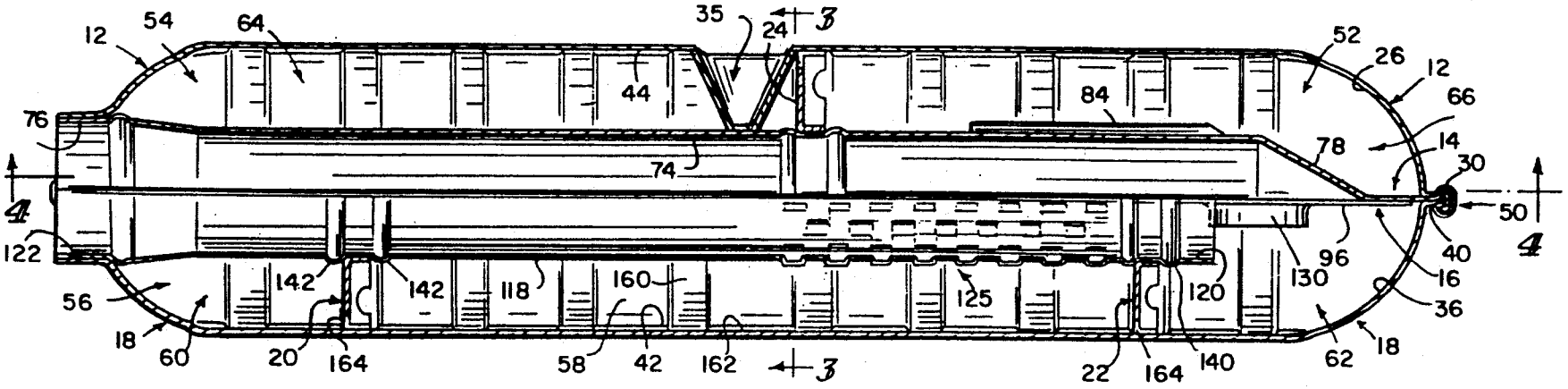
FIG. 2 is a longitudinal sectional view of the rigidifying muffler assembly of FIG. 1 after assembly showing engagement of the rigidifying structure formed in the top shell and a channel section formed in the top internal plate to rigidify the muffler assembly.

This spaced-apart configuration of the top and bottom shell halves 12, 18 permits the full tuning plate 14 to be nested within perimetrically extending skirt 40 of top shell half 12 in engagement with perimeter shelf 28. Also, bottom shell half 18 can be nested within the perimeter flange 46 of full tuning plate 14 so that perimeter web 38 engages a flat surface 48 of full tuning plate 14. Once nested, the three layer sandwich comprising skirt 30, lip 46, and skirt 40 can be rolled using a press to form a mechanical lock 50 as shown best in FIG. 3 clamping the full tuning plate 14 and the top and bottom shell halves 12, 18 together. Advantageously, only three layers of sheet metal must be rolled together to form this mechanical lock 50 because the insert tuning plate 16 is attached directly to the flat surface 48 of full tuning plate 14 as illustrated in FIG. 2.

Mechanical lock 50 provides a solid connection at low cost without the need for a lot of complex welding. Further, a potential weld contamination problem is avoided in cases where an aluminized coating is applied to the sheet metal before welding. It is expected that these three sheet metal layers alternatively could be connected using laser welding techniques or the like.

The full tuning plate 14 is configured to cover the open mouth of basin 26 when it is nested within perimetrically extending skirt 30 to engage perimeter shelf 28. In such a nested position, full tuning plate 14 partitions the muffler chamber 52 formed inside muffler assembly 10 upon union of the top and bottom shell halves 12, 18 into first and second chambers 54, 56 as shown best in FIG. 2. The hollow basin 26 in top shell half 12 defines the boundary of first chamber 54 and the complementary hollow basin 36 in bottom shell half 18 defines the boundary of second chamber 56. As shown best in FIG. 2, the first and second drop-in baffles 20, 22 are arranged to partition the second chamber 56 into a central expansion chamber 58 and a pair of spaced-apart exhaust turnaround chambers 60, 62 in the bottom shell half 18. Further, the third drop-in baffle 24 is arranged to divide the first chamber 54 into a pair of resonance chambers 64, 66 in the top shell half 12.

The full tuning plate 14 is stamp-formed to include a flat surface 48 on which the insert tuning plate 16 is mounted and a plurality of recessed channels and apertures which cooperate with certain surfaces of the insert tuning plate 16 to guide flow of exhaust gas into and out of the muffler chamber 52 and the two resonance chambers 64, 66. As shown in FIG. 1, the full tuning plate 14 provides a first inlet channel section 68 extending between a mouth section 70 configured to nest in inlet opening 32 of top shell half 12 and a conic section 72 situated in the first turnaround chamber 60. A first outlet channel section 74 is provided in full tuning plate 14 and extends from a mouth section 76 configured to nest in outlet opening 34 of the top shell half 12 and a conic section 78 situated in the second turnaround chamber 62. As shown best in FIGS. 2 and 3, the rigidifying structure 35 formed in the top shell half 12 engages the first outlet channel section 74 to provide strength and support to the top shell half 12. It will be understood that such a rigidifying structure 35 could be relocated on top shell half 12 to engage other sites on tuning plate 14 as shown, for example, in phantom lines in FIG. 9. The location of each rigidifying structure 35 inside muffler assembly 10 is selected to provide adequate support for the outer shells and to minimize shell noise.

Full tuning plate 14 is also formed to include a first tuning throat channel 80 leading from first turnaround chamber 60 to an aperture 82 in flat surface 48 to conduct exhaust gas from the first turnaround chamber 60 into the first resonance chamber 64. Likewise, a second tuning throat channel 84 leading from second turnaround chamber 62 to an aperture 86 in flat surface 48 is formed in full tuning plate 14 to conduct exhaust gas from the second turnaround chamber 62 into the second resonance chamber 66.

As shown in FIG. 1, the first inlet and outlet channel sections 68, 74 and the tuning throat channels 80, 84 are aligned in three spaced-apart parallel rows to provide enough room on flat surface 48 between the rows and around the channels to support a companion surface of insert tuning plate 16. Preferably, a seam weld (not shown) is used to connect the flat surface 48 between these channel rows and around the channels to attach the insert tuning plate 16 securely to the full tuning plate 14. Advantageously, using this technique, it is not necessary to provide a perimeter flange on the insert tuning plate 16 and add this flange as a fourth layer to the three-layer sandwich which must be rolled to form the mechanical lock 50 clamping the muffler assembly 10 components together. It will be appreciated that manufacturability of muffler assembly 10 is improved by keeping the number of layers that must be rolled to provide mechanical lock 50 (or welded to provide a welded joint) to a minimum.

The full tuning plate 14 also includes an auxiliary tuning tube 90 extending through an aperture formed in flat surface 40 to interconnect the first resonance chamber 64 and the expansion chamber 58 in fluid communication. Auxiliary tuning tube 90 includes an inlet 94 positioned in first resonance chamber 64 and an outlet 92 positioned in expansion chamber 58 as shown best in FIG. 3. Advantageously, provision of such an auxiliary tuning tube 90 acts to enhance the acoustic tuning capabilities of muffler assembly 10 by providing a second entry path for admission of exhaust gas into the first resonance chamber 64. It will be appreciated that it is possible to vary both the size and the location of tuning tube 90.

The insert tuning plate 16 is configured to nest within the perimetrically extending lip or flange 46 provided on full tuning plate 14 and to attach to flat surface 48 of the full tuning plate. Advantageously, the weight of insert tuning plate 16 is reduced because of its smaller size in comparison to the larger full tuning plate 14. Specifically, the area of flat surface 96 on insert tuning plate 16 can be kept to a minimum as shown best in FIGS. 1 and 5 because this flat surface 96 is used primarily to provide an attachment flange coupled to flat surface 48 of the full tuning plate 14 by seam weld 88 or other appropriate weld and to provide a cover for each of the first and second tuning throat channels 80 and 84.

The insert tuning plate 16 is stamp-formed to include a second inlet channel section 110 having a mouth section 112 configured to mate with an inlet opening 114 formed in bottom shell half 18 and an exit section 116 emptying into the first exhaust turnaround chamber 60. A second outlet channel section 118 is also formed in insert tuning plate 16 having an intake section 120 communicating with the second exhaust turnaround chamber 62 and a mouth section 122 configured to mate with an outlet opening 124 formed in bottom shell half 18. Louver sections 125 are desirably provided in each of channel sections 110 and 118.

The first and second inlet channel sections 68, 110 cooperate to define an elongated inlet tube for conducting exhaust gas from an inlet port of the muffler assembly 10 into the first exhaust turnaround chamber 60 upon joinder of the tuning plates 14, 16 to one another. Similarly, the first and second outlet channel sections 74, 118 cooperate to define an elongated outlet tube for conducting exhaust gas from the second turnaround chamber 62 to an outlet port of the muffler assembly 10.

The largest part of flat surface 96 on insert tuning plate 16 extends along the length of second outlet channel section 118 as shown best in FIG. 1 and provides a first throat inlet aperture 126 opening into first exhaust turnaround chamber 60, an auxiliary throat aperture 128 opening into expansion chamber 58, and a second throat inlet aperture 130 opening into second exhaust turnaround chamber 62. The first throat inlet aperture 126 conducts exhaust gas from first turnaround chamber 60 through the flat surface 96 into the underlying first tuning throat channel 80 stamp-formed in full tuning plate 14 for delivery to the first resonance chamber 64 via plate aperture 82. Likewise, the second throat inlet aperture 130 conducts exhaust gas from second turnaround chamber 62 through the flat surface 96 into the underlying second tuning throat channel 84 stamp-formed in full tuning plate 14 for delivery to the second resonance chamber 66 via plate aperture 86. The diameter of auxiliary throat aperture 128 is selected to pass the inlet 94 of auxiliary tuning tube 90 therethrough upon attachment of the insert tuning plate 16 to the flat surface 48 of full tuning plate 14.

Each of the first and second drop-in baffles 20, 22 is stamped to form a flat vertical wall 132 and a plurality of mounting flanges 134 around the perimeter of vertical wall 132. First and second semicircular flanges 136, 138 are provided along a bottom edge of baffles 20, 22 for mating with the half round exterior surface of the second inlet and outlet channel sections 110, 118 of the insert turning plate 16. A first pair of raised, semicircular sealing beads 140 are formed in each of the exterior surface of channel sections 110, 118 at the interface between the second turnaround chamber 62 and the expansion chamber 58 as shown best in FIG. 1. Similarly, a second pair of raised, semicircular sealing beads 142 are formed in each of the exterior surface of channel sections 110, 118 at the interface between the expansion chamber 58 and the first turnaround chamber 60. The sealing beads 140, 142 on each channel section are laterally spaced apart as shown in FIG. 1 to receive one of the semicircular flanges 136, 138 provided on the bottom edge of the baffles 20, 22. These sealing beads advantageously improve the gas and vapor seal provided between each of the baffles 20, 22 and the insert turning plate 16 once the baffles 20, 22 are spot-welded in place on plate 16.

Each of first and second drop-in baffles 20, 22 also includes a field of perforations 144 of the like which overlies the widest section of flat surface 96 upon attachment of baffles 20, 22 to inset turning plate 16. The perforations 114 allow exhaust gas in the first exhaust turnaround chamber 60 to travel to the second exhaust turnaround chamber 62 via the expansion chamber 62. In effect, the bottom shell half 18 and the insert turning plate 16 cooperate with the help of perforated drop-in baffles 20, 22 to establish a return passageway interconnecting the outlet aperture of the elongated inlet tube provided by first and second inlet channel sections 68, 110 and the intake aperture of the elongated outlet tube provided by the first and second outlet channel sections 74, 118 in fluid communication. Advantageously, the entire second chamber 56 provided in the hollow basin 36 of the bottom shell half 18 functions as a return passage for exhaust gas from the inlet tube to the outlet tube, which return passage is also in communication with resonance chambers 64, 66.

The third drop-in baffle 24 is similar in configuration to the other two drop-in baffles 20, 22 and is attached to the full tuning plate 14 as shown best in FIG. 2 to provide a barrier separating the two resonance chambers 64, 66 provided in the top shell half 12. The location of first and second semicircular flanges 146, 148 is complementary to the location of those flanges 136, 138 on baffles 20, 22 to permit baffle 24 to mate properly with the half round exterior surfaces of the first inlet and outlet channel sections 68, 74 formed in full tuning plate 14. A pair of annular sealing bead pairs 150 is also provided on each of channel sections 68, 74 at the interface between the first and second resonance chambers 64, 66 to enhance the vapor and gas seal provided by the third drop-in baffles 24 between those two resonance chambers 64, 66. Of course, vertical wall 152 of third drop-in baffle 24 does not include any perforations therein so that direct communication between the first and second resonance chambers 64, 66 is blocked. A plurality of mounting flanges 154 are formed along the perimeter of vertical wall 152 to provide means for attaching the third drop-in baffle 24 to the full tuning plate 14 and the top shell half 12.

The basins 26, 36 in each of the top and bottom shell halves 12, 19 include a plurality of spaced-apart transversely extending exterior ribs 156 and a longitudinally extending exterior rib 158 arranged to intersect each of the transversely extending ribs 156 at right angles as shown in FIG. 1. The transverse ribs 156 and the longitudinal rib 158 are formed by pressing on an inner wall of basins 26, 36 to press enough material in an outward direction to form the ribs 156, 158. These intersecting ribs 156, 158 advantageously function to stiffen shell halves 12, 18 considerably and also control shell noise which often occurs upon vibration of a muffler during use. Shell noise is lessened because the entire surface of each shell half 12, 18 is more rigid and less prone to vibration.

At the same time, the transverse ribs 156 provide transversely extending channels 160 along the inner wall of each hollow basin 26, 36 as shown best in FIGS. 1 and 2. These transverse channels 160 are dimensioned to receive the mounting flanges 134, 154 on each of the drop-in baffles 20, 22, 24 so that each baffle can be properly and easily aligned and fixtured in its shell half prior to welding the baffle to the shell half. A line of small exterior-opening, baffle-access apertures can be formed in each shell half in each transverse rib which is designated to receive a baffle in its companion transverse channel so that the drop-in baffle can be welded to the abutting top shell through such baffle-access apertures once the muffler unit 10 is essentially fully assembled. Advantageously, the transverse channels 160 function as welding fixtures to hold the drop-in baffles in a selected position and orientation with respect to the abutting shell half during assembly and welding.

As shown in FIG. 1, longitudinal ribs 158 provide a longitudinally extending channel 162 in each basin 26 and 36. Advantageously, this longitudinal channel 162 functions to collect condensate that may develop in a relatively cool region of the muffler assembly 10 and deliver the condensate to a hotter region therein where it will naturally vaporize and become entrained in the exhaust gas discharged from the muffler assembly 10. It has been observed that any condensate which collects in the bottom portion of a muffler can freeze during cold weather and prevent a vehicle engine connected to the muffler from starting.

In use, the muffler assembly 10 will be typically mounted in a horizontal orientation as shown in FIG. 2. Longitudinal channel 162 is provided in a low portion of bottom shell half 18 and will collect any condensate developing in the basin and deliver it to a hotter region of the basin for vaporization. Conveniently, any condensate developing on the inner side walls of the basin will be funneled into the longitudinal channel 162. The transverse channels 160 which do not contain a drop-in baffle function, in effect, as tributaries which extend into regions where condensate is likely to develop during muffler operation to collect condensate and funnel or feed it into the longitudinal channel 162 for delivery to a destination in the second chamber 56.

Figure 3:
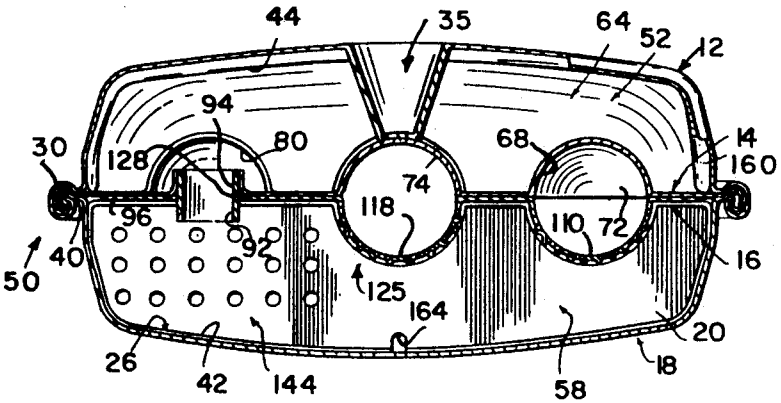
FIG. 3 is a transverse sectional view of the muffler assembly taken along lines 3—3 of FIG. 2 showing engagement of the rigidifying structure and the channel section from another vantage point.

A longitudinal condensate delivery channel 162 is normally provided in each shell half 12, 18 so that the muffler assembly 10 is able to handle condensate delivery regardless of whether the muffler assembly 10 is mounted with the top or bottom shell 12, 18 in the gravitationally lowest position. Conveniently, each drop-in baffle 20, 22, and 24 is formed to include an aperture 164 (as shown in FIG. 3) at its perimeter edge in a location engaging in the longitudinal channel 162 so that condensate conducted through channel 162 is not blocked or otherwise obstructed by the baffles 20, 22, 24. It is also possible to provide a valved or valveless drainage port in at least one of the shell halves 12, 18 in communication with longitudinal channel 162 to permit manual or automatic draining of condensate from muffler assembly 10.

Figure 4:
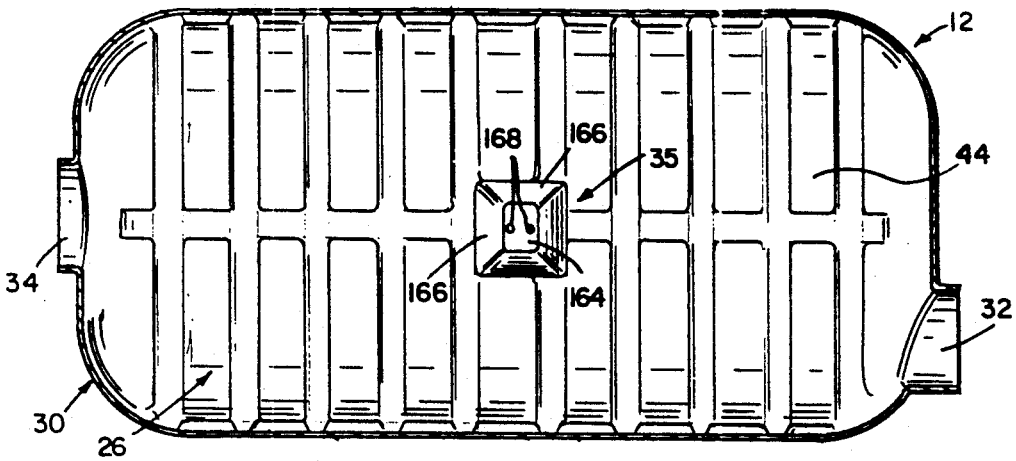
FIG. 4 is a sectional view of the interior region of the top shell taken along lines 4—4 of FIG. 2 showing the rigidifying structure.
Figure 5:
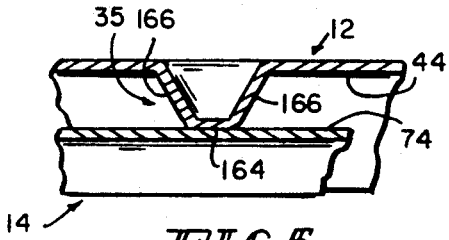
FIG. 5 is a diagrammatic sectional view of the rigidifying structure shown in the embodiment of FIGS. 1-4.

Two additional views of the rigidifying structure 35 illustrated in the embodiment of FIGS. 1-3 are shown in FIGS. 4 and 5. It will be understood that top shell half 12 is stamp-formed to produce an inwardly extending protrusion that is configured to serve as rigidifying structure 35. This rigidifying structure 35 illustratively includes a base 164 configured to mate with a designated portion on inner tuning plate 14 and various side walls 166 appended to base 164 to form a shape somewhat similar to a frustrum of a pyramid. Base 164 could have a contoured shape fitted to mate with a contoured surface of the type exhibited by channel section 74. Alternatively, base 164 could have a flat surface to mate with a flat section on inner tuning plate 14.

Two small holes 168 are formed in the base 164 of the rigidifying structure 35 to allow welding of the base 164 to the channel section 74 of the inner tuning plate 74. The rigidifying structure 35 will tend to stabilize, support, and rigidify the top shell half 12. Establishing a welded connection between the rigidifying structure 35 and the inner tuning plate 14 can enhance the shell noise suppression benefits resulting from use of rigidifying structure 35.

Figure 6:
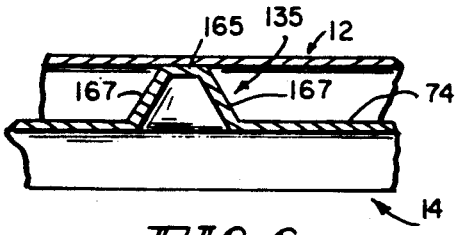
FIG. 6 is a view similar to FIG. 5 showing a second embodiment of a rigidifying structure.

A second embodiment of a rigidifying means is illustrated in FIG. 6. The inner tuning plate 14 is stamp-formed to include an outwardly extending protrusion configured to provide a rigidifying structure 135. This rigidifying structure 135 is illustratively appended to one of the channel-forming sections 68, 74 on the inner tuning plate 14 although alternatively it could be appended to any other portion of the inner tuning plate 14 (or any other internal plate or element in a muffler assembly). Rigidifying structure 135 illustratively includes base 165 and four side walls 167 and has a shape similar to that of rigidifying structure 35. Again, base 165 can be formed to include one or more holes (not shown) like holes 168 to permit the base 165 to be welded easily to the top shell half 12.

Figure 7:
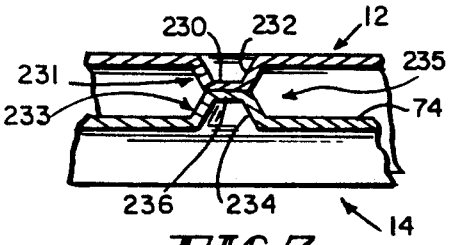
FIG. 7 is a view similar to FIG. 5 showing a third embodiment of a rigidifying structure.

A third embodiment of a rigidifying means is illustrated in FIG. 7. Both of the top shell half 12 and inner tuning plate 14 are stamp-formed to produce protrusions 231 and 233 which mate to provide a rigidifying structure 235. It will be understood that protrusion 233 could be appended to any portion of the inner tuning plate 14 and not just the channel-forming section 74 as shown in FIG. 7. Top protrusion 231 illustratively includes a base 230 and four sides 232 and bottom protrusion 233 illustratively includes a base 234 and four sides 236. Holes similar to holes 168 can be formed in one of bases 230 and 234 to enhance weldability of the protrusions 231 and 233 to form rigidifying structure 235.

Figure 8:
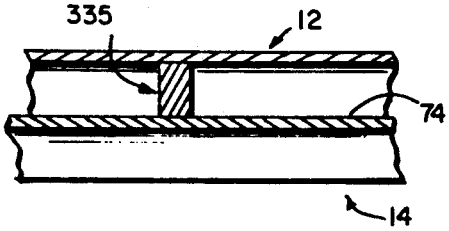
FIG. 8 is a view similar to FIG. 5 showing a fourth embodiment of a rigidifying structure.

In the fourth embodiment of a rigidifying means illustrated in FIG. 8, an insert bridge member 335 is provided to interconnect the top shell half 12 and inner tuning plate 14. This insert bridge member 335 could be formed from sheet metal, weld studs or rods, etc. Holes for welding to at least one of the top half shell 12 and the channel-forming section 74 would be required.

Figure 9:
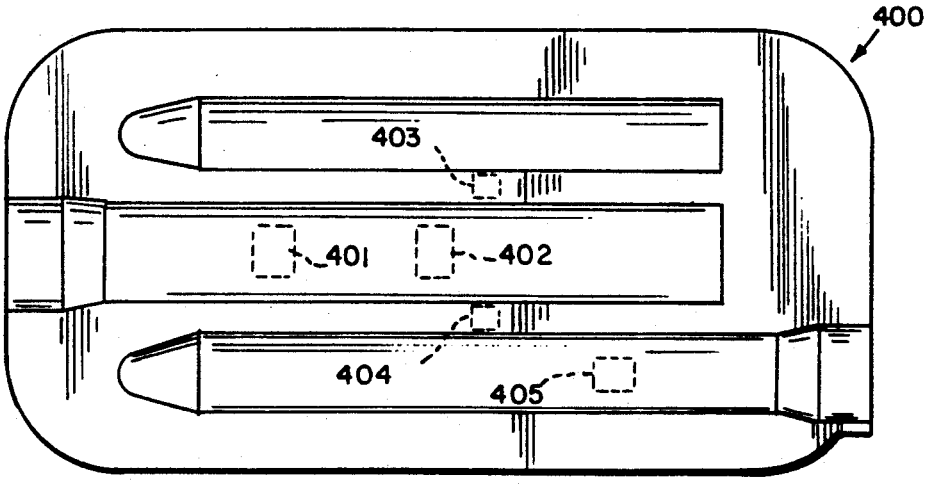
FIG. 9 is a top plan view of a top internal plate similar to the top internal plate shown in FIGS. 1-3 showing, in phantom, various sites on the top internal plate that could be designated to engage a rigidifying structure formed in or connected to the top shell to rigidify the muffler assembly.

Another embodiment of a tuning plate is illustrated in FIG. 9 to show various attachment sites for rigidifying structures. This tuning plate 400 has a different configuration of channel sections than either of the plates shown in FIG. 1. Rigidifying structures of the type shown, for example, in the embodiments of FIGS. 5-8 could be provided essentially anywhere on tuning plate 400 to attach to and rigidify an outer shell (not shown) adjacent to the tuning plate 400. For example, a rigidifying structure can be situated at one or more of sites 401,405. At least one or more rigidifying structures can be used dependent on the amount of stiffening needed. Thus it can be seen that the rigidifying structures in accordance with the present invention can be used on any type of stamp-formed muffler needing rigidifying.

Rigidifying structures in accordance with the present invention are well-suited for use in the interior region of any muffler assembly to support one or more of the outer shells and thereby minimize shell noise problems. It will be understood that these rigidifying structures can be used in mufflers that do not include drop-in baffles. Advantageously, a rigidifying structure in accordance with the present invention strengthens and stiffens a muffler assembly without subdividing the interior region of the muffler assembly into more subchambers.

In another embodiment of the invention, muffler assembly 510 is formed to include a top shell half 512, a bottom shell half 514, a first drop-in baffle 520, and a second drop-in baffle 522. The baffles 520 and 522 are disposed between the top shell half 512 and the bottom shell half 514. In the illustrated embodiment, each of these components is stamp-formed sheet metal. For example, aluminized and non-aluminized cold-rolled steel or AISI/SAE grade 409 stainless steel are suitable for stamping to form the stamped components of muffler assembly 510.

Figure 10:
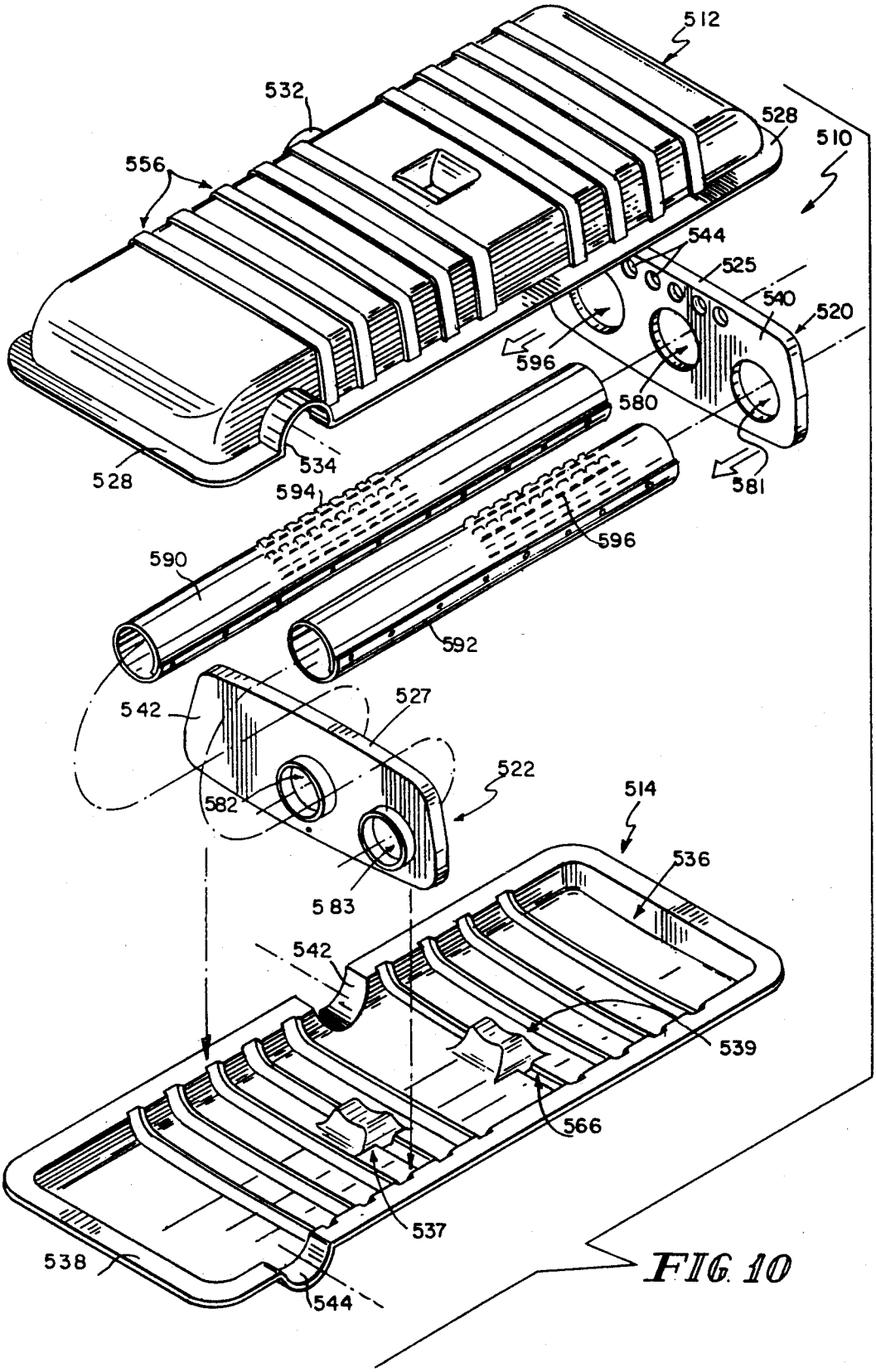
FIG. 10 is an exploded view showing assembly of another embodiment of a muffler according to the present invention.
Figure 11:
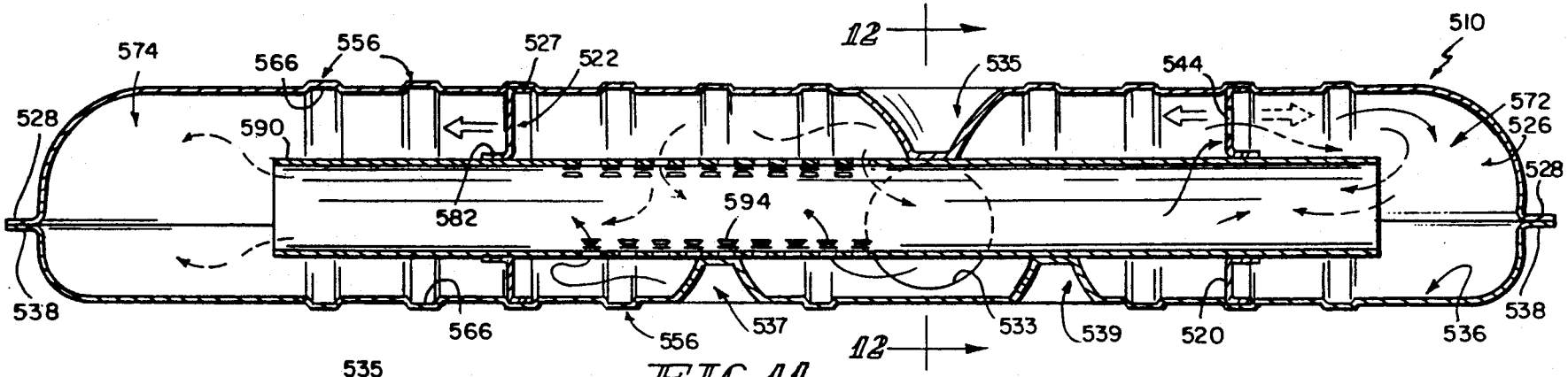
FIG. 11 is a longitudinal sectional view of the muffler shown in FIG. 10 after assembly, showing in order from left to right the third, first, and second chambers defined by the second drop-in baffle and the first drop-in baffle held in place by channels formed in the top and bottom shell halves.

As generally shown in FIGS. 10 and 11, top shell half 512 includes a hollowed basin 526 (shown in sectional view in FIG. 11) having a flat horizontal perimeter shelf 528 around the cavity provided by basin 526. The basin 526 is cut away as shown at 532 to provide an inlet opening into basin 526 (shown in sectional view in FIG. 11) having a flat horizontal perimeter shelf 528 around the cavity provided by basin 526. The basin 526 is cut away as shown at 532 to provide an inlet opening into basin 526 and at 534 to provide an outlet exiting basin 526.

Bottom shell half 514 likewise includes a hollowed basin 536 and a flat horizontal perimeter shelf 538 surrounding the cavity provided by basin 536. The basin 536 is cut away as shown at 542 to provide an inlet opening into basin 536 and at 544 to provide an outlet exiting basin 536. The positioning of the cut-away portions of basin 536 at 542 and 544 is selected to match the similar cut-away portions 532 and 534 of basin 526 to that when the top shell 514 and the bottom shell 514 are brought together as shown in FIG. 11, a substantially cylindrical inlet aperture 533 (shown in FIGS. 11 and 12) and outlet aperture 535 are formed.

The basins 526, 536 in each of the top and bottom shell halves 512 and 514 include a plurality of spaced-apart transversely extending exterior ribs 556. The transverse ribs 556 are formed by stamp-pressing on an inner wall of basins 526, 536 to press enough material in an outward direction to form the ribs 556. These ribs 556 advantageously function to stiffen shell halves 512 and 514 against mechanical movement and also control shell noise which often occurs upon vibration of a muffler during use. Shell noise is lessened because the entire surface of each shell half 512 and 514 is made more rigid and therefore less prone to vibration.

Stamp-forming the transverse ribs 556 also acts to form a plurality of indenting channels 566 in both the shell halves 512 and 514. These channels 566 are dimensioned to accept insertion of baffle edges 525 and 527 of the drop-in baffles 520 and 522, respectively.

As best shown in FIG. 11, the drop-in baffles 520 and 522 can be inserted into any one of the plurality of channels 566 to define (in conjunction with the shell halves 512 and 514) a first chamber 570 positioned to lie between a second chamber 572 and a third chamber 574. The inlet 533 for vehicular exhaust gases (exhaust gas movement indicated by arrows in FIG. 11) opens into the first chamber 570 and the outlet 535 provides an exit for exhaust gases from the third chamber 574.

The baffles 520 and 522 are usually stamp-formed from sheet metal. As with the muffler shells 512 and 514, the baffles 520 and 522 can be formed from aluminized and non-aluminized cold-rolled steel or AISI/-SAE grade 409 stainless steel. Each of the first and second drop-in baffles 520, 522 is respectively stamped to form a flat vertical wall 540 and 542. The first drop-in baffle 520 also includes a field of perforations 544 defined in the vertical wall 540 which allow fluid communication between the first chamber 570 and the second chamber 572. The perforations 544 allow exhaust gas in the first chamber 570 to travel to the second chamber 572 and also act to permit attenuation of a broader range of acoustic frequencies than is possible if the first and second chambers 570 and 572 did not have such a field of perforations 544. In addition to these perforations 544, the vertical wall 540 of the drop-in baffle 520 is formed to include an aperture 546 having real dimensions comparable to that of the area dimensions of the inlet aperture 533. Exhaust gases entering the first chamber 570 from the inlet aperture 533 can flow through the aperture 546 into the second chamber 572.

Both the baffles 520 and 522 also respectively define apertures 580 and 581 (through baffle 520) and apertures 582 and 583 (through baffle 22). These apertures 580, 581, 582, and 583 generally have similar dimensions and are sized to accept insertion therethrough of commercially available tubing. As shown in FIG. 10, a first exhaust flow tube 590 is configured to pass through the apertures 580 and 582 of baffles 520 and 522, and a second exhaust flow tube 592 is configured to pass through the apertures 581 and 583 of the baffles 520 and 522. In the embodiment shown, the apertures 580, 582, and 581, 583 are respectively aligned so that straight sections of flow tubes 590 and 592 can pass therebetween.

The flow tubes 590 and 592 can be constructed from commercially available steel tubing produced by either extrusion or roll-forming. In the embodiment shown, the tubes 590 and 592 are formed from rolled steel that is spot-welded to fix its tubular shape. The flow tubes 590 and 592 can optionally be equipped with louver sections 594 and 596 to permit transfer of exhaust gasses between the tubes 590 and 592 and the first chamber 570.

Figure 12:
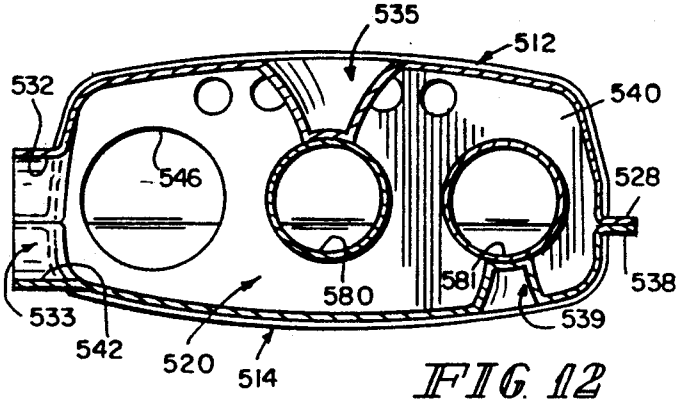
FIG. 12 is a transverse sectional view taken along lines 12—12 of FIG. 11 showing the apertures defined by the second drop-in baffle.

The top shell half 512 further includes a rigidifying structure 535 and the bottom shell half 514 includes a pair of rigidifying structures 537, 539 as shown in FIGS. 10–12. The rigidifying structure 535 is configured to engage a portion of flow tube 580 as shown in FIGS. 11 and 12 to add rigidity to muffler assembly 510. Rigidifying structures 537, 539 are configured to engage a portion of flow tube 581 as also shown in FIGS. 11 and 12 to add rigidity to muffler assembly 510. Each of these rigidifying structures serves to support one of the shell halves 512, 514 relative to one of the flow tubes 580, 581 in muffler assembly 510 to minimize shell noise without dividing the interior region of the muffler assembly 510 into any more subchambers. It is within the scope of this invention to employ one or more rigidifying structures to support each of the shell halves 512, 514 in muffler assembly 510.

It will be understood that rigidifying structures of the type illustrated in FIGS. 5–8 could be adapted for use in connection with muffler assembly 510. As described previously, small holes can be formed in the base of each rigidifying structure to permit establishment of a welded connection between the rigidifying structure and a flow tube. Such welding can enhance the shell noise suppression benefits resulting from use of the rigidifying structures. Of course, mechanical means could also be used to connect a rigidifying structure to a flow tube. Rigidifying structures can be formed to lie in a center region between a pair of spaced-apart drop-in baffles or in other suitable regions inside muffler assembly 510.

The tubes 590 and 592 are spot-welded or otherwise permanently attached to the baffles 520 and 522 so that the vertical walls 540 and 542 of the baffles 520, 522 are held in a parallel, spaced-apart relationship to each other. The spacing is selected to correspond to some distance between pairs of channels 566. This arrangement allows ready modification of the volume of the first, second, or third chambers 570, 572, or 574 by appropriately selecting different distances between the vertical walls 540 and 542, allowing one to select the best combination of chamber sizes to attenuate noise produced by particular vehicle types.

After the baffles 520 and 522 and the tubes 590 and 592 have been attached to each other, the baffles 590 and 592, along with the attached tubes 590 and 592, are then dropped into place into the basin 536 of the lower shell 514 so that the baffle edges 525 and 527 are inserted into the channels 566. The top shell 514 is then placed atop the bottom shell 514 so that the shelf 528 matches the shelf 538 in abutting relationship, and the baffle edges 525 and 527 insertably fit into the channels 566 stamped into the top shell 512. Assembly of the muffler 510 is completed by welding or other permanent attachment of the shelf 528 to the shelf 538.

Figure 13:
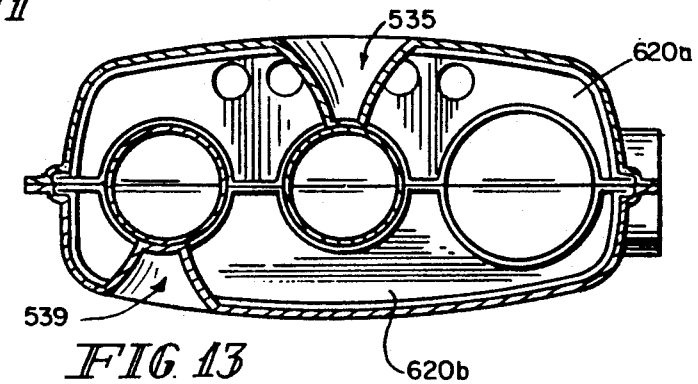
FIG. 13 is a view similar to FIG. 12 showing an alternative embodiment in which half-sized baffles are used instead of full-sized baffles to partition the interior region of the muffler.

It is within the scope of the present invention to use half baffles **620*a*, 620*b* of the type shown, for example, in FIG. 13 instead of the full-size baffles 520, 522 shown in the embodiment of FIGS. 10–12. As shown in FIG. 13, each half baffle 620*a*, 620*b* includes a pair of peripheral mounting flanges 625 at its opposite ends. These mounting flanges 625 are configured to extend into the space provided between the shelves 528, 538 of the top and bottom shells 512, 514 during assembly of the muffler. Once the top and bottom shells 512, 514 are connected to one another, the mounting flanges 625 are trapped between the shelves 528, 538 to hold the half baffles 620*a*, 620*b* can also be fit into an indentation formed in either the top or bottom shell 512, 514 as required to locate said half baffle 620*a*, 620*b*** in a selected position within the muffler assembly. Reference is hereby made to U.S. Pat. No. 4,941,545, issued Jul. 17, 1990, for a description of half baffles suitable for use in connection with the present invention.

Although the invention has been described in detail with reference to certain preferred embodiments, variations, and modifications exist within the scope and spirit of the invention as described and defined in the following claims.

We claim:

1. A muffler assembly having an inlet and an outlet, the muffler assembly comprising a first half shell, a second half shell joined to said first half shell to define an enclosed area therebetween, a first internal plate containing depressions therein and abutting and located between said half shells to divide said enclosed area into two chambers, a second internal plate containing depressions therein and contacting said first internal plate, said depressions in said two internal plates facing each other to define gas passages therebetween communication with the inlet and outlet for the muffler assembly, at least one divider means located in each chamber and contacting one half shell and at least one internal plate to divide each chamber into a plurality of subchambers, and rigidifying means between at least one half shell and one of said depressions to fixedly secure said depression to said one half shell to reduce vibrations of said one half shell, the rigidifying means extending between the at least one half shell and one of the said depressions to support the at least one half shell without dividing the subchambers therebetween into a further subchamber and without significantly filling a volume of any subchamber.

2. The muffler assembly of claim 1, wherein there are plural rigidifying means and wherein more than one depression has a rigidifying means.

3. A muffler assembly according to claim 2, wherein the rigidifying means is formed at least in part by a raised portion of at least one of said half shells and said depressions.

4. A muffler assembly according to claim 3, wherein the rigidifying means is formed from contacting raised portions from at least one said half shell and from at least one said depression.

5. A muffler assembly of claim 2, wherein each depression has a rigidifying means.

6. A muffler assembly according to claim 5, wherein the rigidifying means is formed at least in part by a raised portion of at least one of said half shells and said depressions.

7. A muffler assembly according to claim 6, wherein the rigidifying means if formed from contacting raised portions from at least one said half shell and from at least one said depression.

8. A muffler assembly according to claim 1, wherein the rigidifying means provides a welded connection between said depressions and said half shells.

9. A muffler assembly according to claim 2, wherein the rigidifying means provides a welded connection between said depressions and said half shells.

10. A muffler assembly according to claim 3, wherein the rigidifying means provides a welded connection between said depressions and said half shells.

11. A muffler assembly according to claim 4, wherein the rigidifying means provides a welded connection between said depressions and said half shells.

12. A muffler assembly according to claim 5, wherein the rigidifying means provides a welded connection between said depressions and said half shells.

13. A muffler assembly according to claim 6, wherein the rigidifying means provides a welded connection between said depressions and said half shells.

14. A muffler assembly according to claim 7, wherein the rigidifying means provides a welded connection between said depressions and said half shells.

15. A muffler assembly having an inlet and an outlet, the muffler assembly comprising a first half shell, a second half shell joined to said first half shell to define an enclosed area therebetween, a first internal plate containing depressions therein and abutting and located between said half shells to divide said enclosed area into two chambers, a second internal plate containing depressions therein and contacting said first internal plate, said depressions in said two internal plates facing each other to define gas passages therebetween communication with the inlet and outlet for the muffler assembly, at least one divider means located in each chamber and contacting one half shell and at least one internal plate to divide each chamber into a plurality of subchambers, and rigidifying means between at least one half shell and one of said depressions to fixedly secure said depression to said one half shell to reduce vibrations of said one half shell, the rigidifying means extending between the at least one half shell and one of the said depressions to support the at least one half shell without dividing the chamber therebetween into a further subchamber, the rigidifying means being formed at least in part by a raised portion of at least one of said half shells and said depressions.

16. A muffler assembly according to claim 15, wherein the rigidifying means is formed from contacting raised portions from at least one said half shell and from at least one said depression.

17. A muffler assembly according to claim 15, wherein the rigidifying means provides a welded connection between said depressions and said half shells.

18. A muffler assembly according to claim 16, wherein the rigidifying means provides a welded connection between said depressions and said half shells.

19. A muffler assembly having an inlet and an outlet, the muffler assembly comprising a first half shell, a second half shell joined to said first half shell to define an enclosed area therebetween, a third internal plate containing depressions therein and abutting and located between said half shells to divide said enclosed area into two chambers, a second internal plate containing depressions therein and contacting said first internal plate, said depressions in said two internal plates facing each other to define gas passages therebetween communicating with the inlet and outlet for the muffler assembly, divider means located in at least one of said two chambers to divide said one of said two chambers into at least two subchambers, and rigidifying means between at least one half shell and at least one of said first internal plate, said second internal plate, and said depressions to fixedly secure said at least one first internal plate, second internal plate, and said depressions to said half shell to reduce vibrations of said one half shell, the rigidifying means contacting only a partial cross-section of said at least one first internal plate, second internal plate, and said depressions so as to avoid subdividing any of said chambers into subchambers.

20. A muffler assembly of claim 19 wherein there are plural rigidifying means and wherein more than one depression has a rigidifying means.

21. The muffler assembly of claim 20 wherein each depression has a rigidifying means.

22. A muffler assembly according to claim 19, wherein the rigidifying means is formed at least in part by a raised portion of at least one of said half shells and said depressions.

23. A muffler assembly according to claim 22, wherein the rigidifying means is formed from contacting raised portions from at least one said half shell and from at least one said depression.

24. A muffler assembly according to claim 20, wherein the rigidifying means is formed at least in part by a raised portion of at least one of said half shells and said depression.

25. A muffler assembly according to claim 24, wherein the rigidifying means is formed from contacting raised portions from at least one said half shell and from at least one said depression.

26. A muffler assembly according to claim 19, wherein the rigidifying means is formed at least in part by a raised portion of at least one of said half shells and said depressions.

27. A muffler assembly according to claim 26, wherein the rigidifying means is formed from contacting raised portions from at least one said half shell and from at least one said depression.

28. A muffler assembly according to claim 19, wherein the rigidifying means provides a welded connection between said depressions and said half shells.

29. A muffler assembly according to claim 20, wherein the rigidifying means provides a welded connection between said depressions and said half shells.

30. A muffler assembly according to claim 21, wherein the rigidifying means provides a welded connection between said depressions and said half shells.

31. A muffler assembly according to claim 22, wherein the rigidifying means provides a welded connection between said depressions and said half shells.

32. A muffler assembly according to claim 23, wherein the rigidifying means provides a welded connection between said depressions and said half shells.

33. A muffler assembly according to claim 24, wherein the rigidifying means provides a welded connection between said depressions and said half shells.

34. A muffler assembly according to claim 25, wherein the rigidifying means provides a welded connection between said depressions and said half shells.

35. A muffler assembly according to claim 26, wherein the rigidifying means provides a welded connection between said depressions and said half shells.

36. A muffler assembly according to claim 27, wherein the rigidifying means provides a welded connection between said depressions and said half shells.

37. A muffler assembly having an inlet and an outlet, the muffler assembly comprising a first half shell, a second half shell joined to said first half shell to define an enclosed area therebetween, a first internal plate containing depressions therein and abutting and located between said half shells to divide said enclosed area into two chamber means, a second internal plate containing depressions therein and contacting said first internal plate, said depressions in said two internal plates facing each other to define gas passages therebetween communication with the inlet and outlet for the muffler assembly, divider means located in at least one of said two chambers to divide said one of said two chambers into at least two subchambers, and rigidifying means only extending between a portion of at least one half shell and a portion of at least one of said depressions to fixedly secure said portion of said depression to said portion of said half shell to reduce vibrations of said one half shell, the rigidifying means extending between the at least one half shell and one of said depressions to support the at least one half shell without dividing the chamber means therebetween into a further subchamber.

38. The muffler assembly of claim 37, wherein there are plural rigidifying means and wherein more than one depression has a rigidifying means.

39. The muffler assembly of claim 38, wherein each depression has a rigidifying means.

40. A muffler assembly according to claim 39, wherein the rigidifying means is formed at least in part by a raised portion of at least one of said half shells and said depressions.

41. A muffler assembly according to claim 40, wherein the rigidifying means is formed from contacting raised portions from at least one said half shell and from at least one said depression.

42. A muffler assembly according to claim 38, wherein the rigidifying means is formed at least in part by a raised portion of at least one of said half shells and said depressions.

43. A muffler assembly according to claim 42, wherein the rigidifying means is formed from contacting raised portions from at least one said half shell and from at least one said depression.

44. A muffler assembly according to claim 37, wherein the rigidifying means is formed at least in part by a raised portion of at least one of said half shells and said depressions.

45. A muffler assembly according to claim 40, wherein the rigidifying means is formed from contacting raised portions from at least one said half shell and from at least one said depression.

46. A muffler assembly having an inlet and an outlet, the muffler assembly, comprising first and second shells joined together to define an enclosed area therebetween, at least one plate disposed in the interior region between the shells and attached to at least one of the shells, at least one rigidifying structure extending between the at least one plate and one of the shells to support the shell without dividing a space between the at least one plate and the shell into a further subchamber, divider means located in the space between the at least one plate and one shell to divide the space into at least two subchambers, and wherein said rigidifying structure does not significantly fill a volume of any enclosed area or subchambers.

47. The muffler assembly of claim 46, further comprising baffle means for dividing the space between the at least one plate and the shell into two subchambers and wherein the at least one rigidifying structure is situated in one of the two subchambers to lie in spaced relation to the baffle means without subdividing said one subchamber into further subchambers.

48. The muffler assembly of claim 46, wherein the at least one plate is formed to include a channel-forming depression and the at least one rigidifying structure is attached to said channel-forming depression.

49. The muffler assembly of claim 46, wherein the at least one plate is formed to include a channel-forming depression and the channel-forming depression is formed to define the at least one rigidifying structure.

50. The muffler assembly of claim 46, wherein the shell half is formed to define the at least one rigidifying structure.

51. The muffler assembly of claim 46, wherein the at least one plate is formed to define the at least one rigidifying structure.

52. The muffler assembly of claim 46, wherein the shell half is formed to define a portion of the at least one rigidifying structure and the at least one plate is formed to define another portion of the at least one rigidifying structure and said portion and said another portion are appended to one another.

53. The muffler assembly of claim 46, wherein the at least one rigidifying structure is a separate element positioned in said space to abut both of said one of the shells and said at least one plate.

54. A muffler assembly having an inlet and an outlet, the muffler assembly, comprising first and second shells joined together to define an enclosed area therebetween, at least one flow tube disposed in the interior region between the shells and attached to at least one of the shells, and at least one rigidifying structure extending between the at least one flow tube and one of the shells to support the shell without dividing a space between the at least one flow tube and the shell into a further subchamber, divider means located in the space between the at least one plate and one shell to divide the space into at least two subchambers, and wherein said rigidifying structure does not significantly fill a volume of any enclosed area or subchambers.

55. The muffler assembly of claim 54, further comprising baffle means for dividing the space between the first and second shells into two subchambers and wherein the at least one rigidifying structure is situated in one of the two subchambers to lie in spaced relation to the baffle means without subdividing said one subchamber into further subchambers.

56. The muffler assembly of claim 54, wherein the at least one flow tube is formed to include a channel-forming depression and the at least one rigidifying structure is attached to said channel-forming depression.

57. A muffler assembly of claim 54, wherein the at least one flow tue is formed to include a channel-forming depression and the channel-forming depression is formed to define the at least one rigidifying structure.

58. A muffler assembly of claim 54, wherein one of the shells is formed to define the at least one rigidifying structure.

59. The muffler assembly of claim 54, wherein the at least one flow tube is formed to define the at least one rigidifying structure.

60. The muffler assembly of claim 54, wherein one of the shells is formed to define a portion of the at least one rigidifying structure, the at least one flow tube is formed to define another portion of the at least one rigidifying structure, and said portion and said another portion are appended to one another.

61. The muffler assembly of claim 54, wherein the at least one rigidifying structure is a separate element positioned in said space to abut both of said one of the shells and said at least one flow tube.

* * * * *